United States Patent [19]

Roberts

[11] 4,132,512

[45] Jan. 2, 1979

[54] ROTARY SLIDING VANE COMPRESSOR WITH MAGNETIC VANE RETRACTOR

[75] Inventor: Richard W. Roberts, Lombard, Ill.

[73] Assignee: Borg-Warner Corporation, Chicago, Ill.

[21] Appl. No.: 849,157

[22] Filed: Nov. 7, 1977

[51] Int. Cl.[2] ..... F04C 29/10

[52] U.S. Cl. ..... 418/23; 418/158

[58] Field of Search ..... 418/158, 259, 265, 23; 417/284

[56] References Cited

U.S. PATENT DOCUMENTS

| | | | |
|---|---|---|---|
| 1,603,437 | 10/1926 | Wingquist | 418/23 X |
| 2,175,413 | 10/1939 | Sharar | 192/58 R |
| 2,249,059 | 7/1941 | Stenger | 418/158 |
| 2,250,947 | 7/1941 | Carpenter, Jr. | 418/158 X |
| 2,535,267 | 12/1950 | Cline | 418/23 |
| 2,670,895 | 3/1954 | Steensen | 418/158 X |
| 2,696,790 | 12/1954 | Crow | 418/23 |
| 2,880,677 | 4/1959 | Grupen | 418/23 |
| 2,952,249 | 9/1960 | Conover | 418/158 X |
| 4,006,804 | 2/1977 | Fehr | 418/158 X |

*Primary Examiner*—Carlton R. Croyle
*Assistant Examiner*—Leonard E. Smith
*Attorney, Agent, or Firm*—Thomas B. Hunter

[57] ABSTRACT

A rotary sliding vane compressor is provided with magnetic vane retractor means to control the pumping capacity of the compressor without the use of an on/off clutch in the drive system.

21 Claims, 10 Drawing Figures

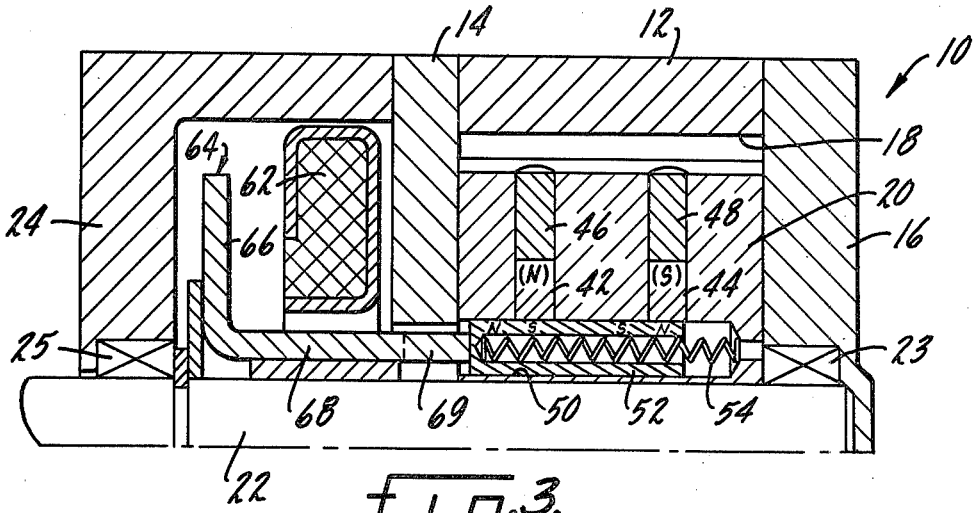
fig.3.
fig.4.
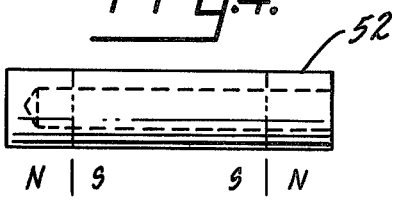
fig.5.
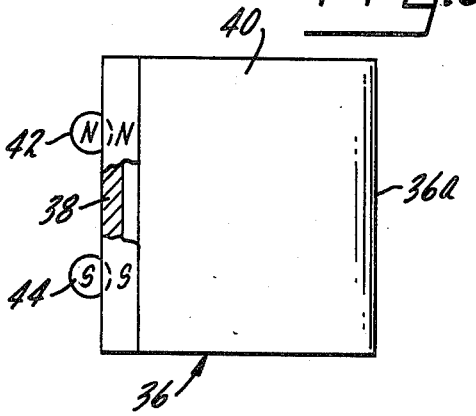
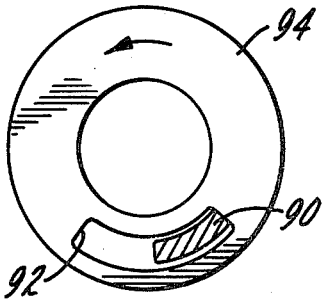
fig.8.
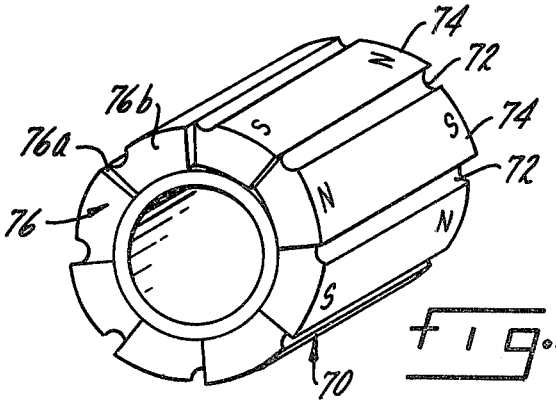
fig.9.
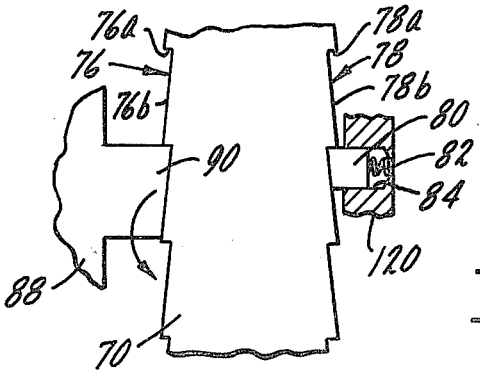
fig.10.

Fig. 6.
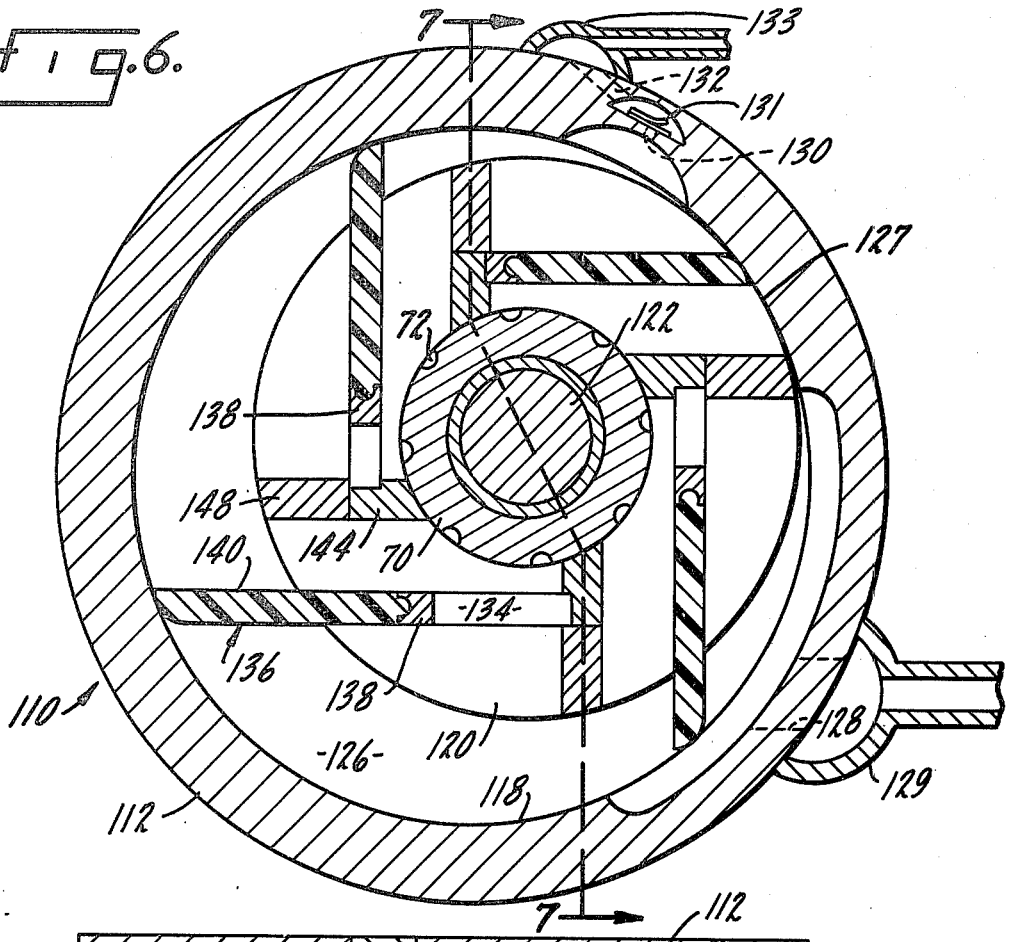
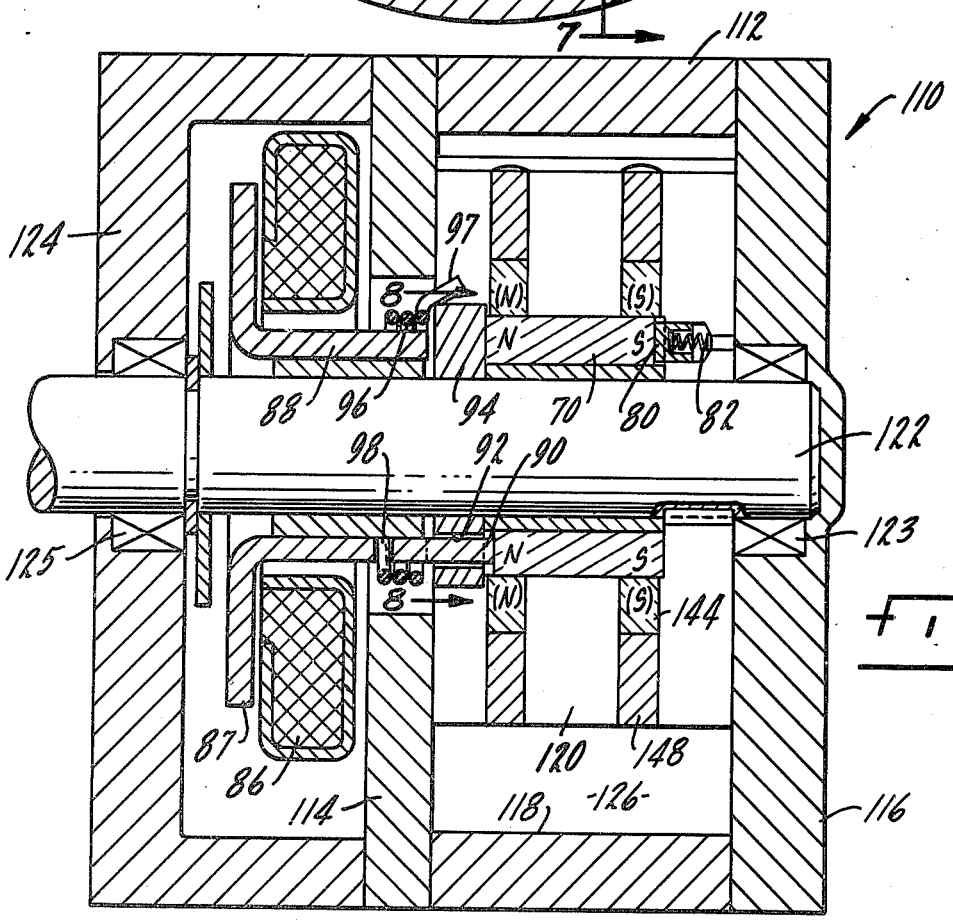
Fig. 7.

ROTARY SLIDING VANE COMPRESSOR WITH MAGNETIC VANE RETRACTOR

BACKGROUND OF THE INVENTION

1. Field of the Invention:

Rotary sliding vane compressors with magnetic means to effect vane retraction when pumping capacity is not wanted. This subject matter is believed to be classified principally in Class 418, Subclass 158.

2. Description of the Prior Art:

Stenger (U.S. Pat. No. 2,249,059) is representative of a number of references showing a rotary sliding vane pump or compressor wherein the vanes are urged outwardly by means of a permanent magnet arrangement. Variations of this same type of apparatus are also found in U.S. Pat. Nos. 2,670,895, 2,952,249 and 2,250,947.

U.S. Pat. No. 2,696,790 shows a mechanical arrangement for moving the vanes radially between fully extended and fully retracted positions so that capacity may be varied. Other mechanical devices for the same purpose may be found in U.S. Pat. Nos. 2,880,677, 2,175,413, 2,535,267 and 1,603,437.

SUMMARY OF THE INVENTION

The present invention is directed to rotary sliding vane compressors which employ permanent magnets which are selectively moveable between two positions: a first position in which the polar relationship between the magnets and the vanes is such that each vane is repelled in an outward direction to maintain the tip of the vane in engagement with the cylinder wall; and a second position in which the polar relationship attracts the vane and holds it in a retracted position with the vane tip out of engagement with the cylinder wall. This, of course, prevents compression of the vapor admitted to the gas working space and reduces the capacity of the compressor to zero.

Two embodiments of the invention are described herein. One utilizes a series of magnets which are engageable by an actuator which forces the magnets into one of the positions mentioned above. When the actuator is de-energized, a spring moves the magnet to the second position. In another embodiment, a magnetic pole sleeve extends through the rotor. The sleeve is formed with a series of bar magnet segments such that there are twice as many discrete magnetic segments as there are vanes. The north and south poles of each magnetic segment alternate, so that by indexing the sleeve by an increment equal to one-half the distance between adjacent vanes, the polarity is reversed; and the vanes can either be made to move outwardly by repulsion of like poles adjacent to each other or to be pulled in a retracted position by the attraction of dissimilar poles acting on the vanes.

DESCRIPTION OF THE DRAWINGS

FIG. 3 is a partial cross-section view, similar to FIG. 1, showing certain parts in a moved position;

FIG. 4 is a plan view of the moveable magnetic actuator pin;

FIG. 5 is a plan view of a vane in relation to the pole pieces in the rotor;

FIG. 6 is a cross-section view of another embodiment of the compressor;

FIG. 7 is a cross-section view taken along the plane of line 7—7 of FIG. 6;

FIG. 8 is a partial elevation view along the plane of line 8—8 of FIG. 7;

FIG. 9 is a perspective view of the magnetized hub member; and

FIG. 10 is a developed view showing the ratchet tooth configuration on opposite sides of the hub in relation to the drive pawl and the detent.

DETAILED DESCRIPTION OF THE INVENTION

Figure 1:
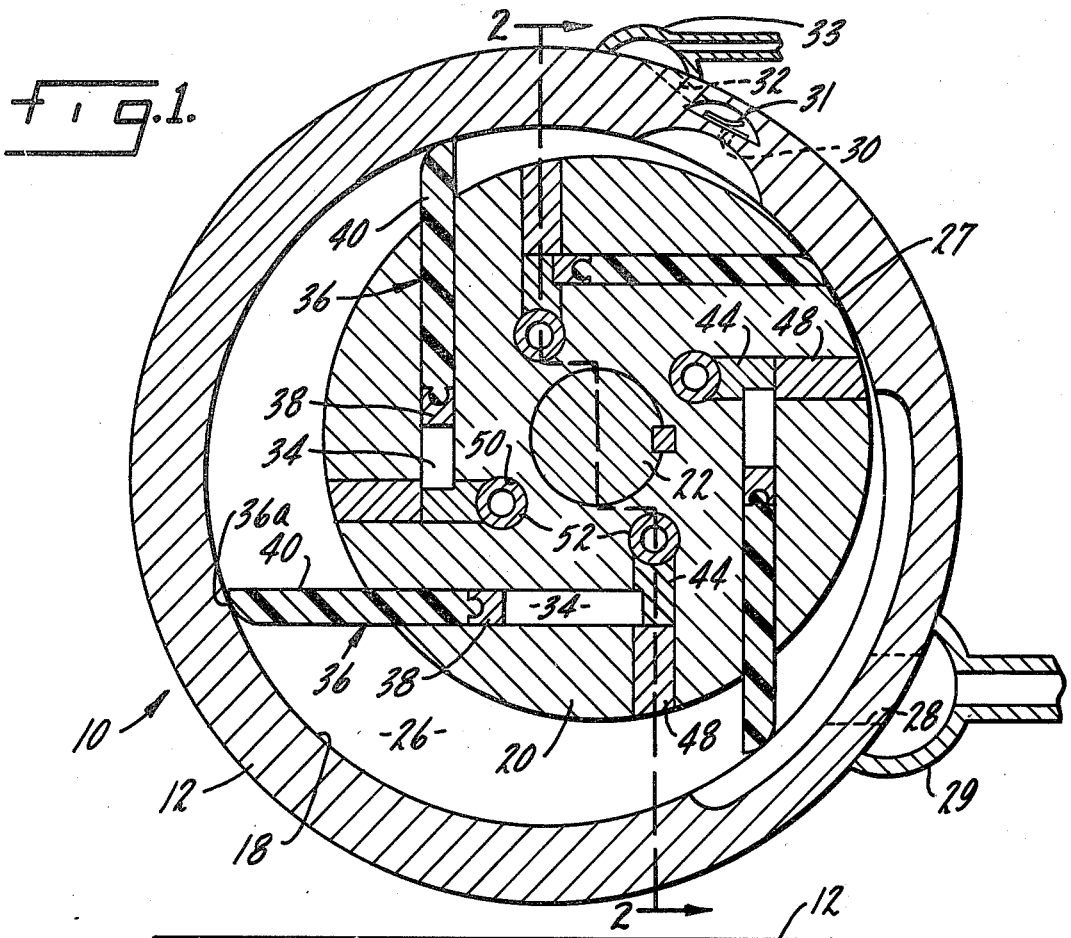
FIG. 1 is a cross-section view of a rotary sliding vane compressor constructed in accordance with the principles of the present invention.
Figure 2:
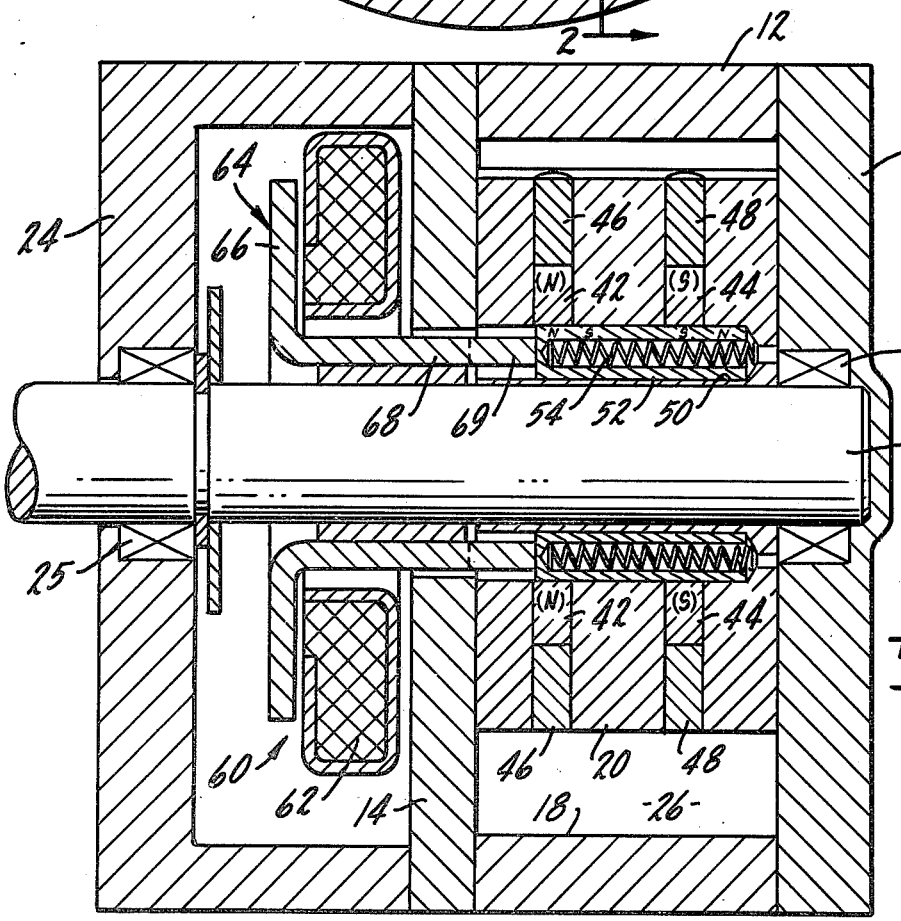
FIG. 2 is a cross-section view taken along the plane of line 2—2 of FIG. 1.

Referring to FIGS. 1 and 2, there is shown a rotary sliding vane compressor including a housing 10 which includes a cylinder body 12, a front plate 14 and a rear plate 16. The cylinder body has a circular bore 18 therein, forming the cylinder of the compressor and into which is received a rotor 20 carried on drive shaft 22. The drive shaft is journalled in the rear plate 16 within bearing 23 and in bearing 25 through housing extension 24 such that the axis of the rotor 20 is not coincident with respect to the axis of cylinder bore 18. The rotor is in running contact with the cylinder at the contact line 27 and thus provides a crescent shaped gas working space 26. A suction passage extends through the cylinder body at 28 and is in fluid communication with a suction gas fitting 29. A discharge port 30 and associated discharge valve 31 immediately adjacent to the contact line is adapted to deliver high pressure gas through passage 32 to a discharge gas fitting 33.

The rotor 20 is provided with a series of slots 34. Each of the slots receives a vane 36 which is generally rectangular in shape and has a tip portion 36*a* engageable with the cylinder wall 18. The base of each vane is provided with a strip of magnetic material 38 (see FIG. 5) while the vane body 40 itself is formed of a nonmagnetic material, such as thermoplastic or a nonmagnetic metal alloy. Inserted within the rotor, which is preferably made of aluminum, are a pair of pole pieces 42 and 44, one set for each vane. Each of the pole pieces are forced into a bore of the same diameter and then sealed with plugs 46, 48 which are nonmagnetic and may be fabricated from the same material as the rotor i.e., aluminum.

A second series of holes 50 is drilled parallel to the axis of rotor 20 and pass immediately adjacent to the pole pieces 42 and 44. These holes 50 are blind at the righthand end thereof (with respect to FIG. 2); and received in each of said holes is an elongated, cylindrical permanent magnet 52, magnetized in such a way that there are a set of spaced N and S poles at each end (see FIG. 4). The magnets are biased to the left by means of springs 54 under compression.

Magnets 52 are capable of assuming two positions. One position is shown in FIG. 2 where the magnet is arranged so that the N and S poles are aligned with the pole pieces 42 and 44. This will cause the magnetic poles to line up with appropriately magnetized sections on the vane so that there is a N—N pole juxtaposition at one side and a S—S juxtaposition on the other. It should be noted that pole pieces 42, 44 are not permanently magnetized but are labelled (N) and (S) to indicate the polarity of the vane edge which is immediately adjacent to the pole pieces, but does not show in FIGS. 2 and 3. The like poles will repel each other and force the vane outwardly in engagement with the cylinder wall. In the other position, shown in FIG. 3, the cylindrical magnet elements are moved to the left causing a S-N, N-S pole juxtaposition of the magnet with respect to the vanes. This will, of course, attract the vanes inwardly and hold the tips out of engagement with the cylinder wall.

Actuation of the magnetic elements may be achieved by means of an electromagnetic actuator 60 which includes a stationary coil 62 adapted to operate on an armature 64. The armature includes a flange 66 and an annular sleeve 68 having pins 69 projecting therefrom and engaging the lefthand ends of magnetic elements 52. When the coil 62 is de-energized, the springs 54 force the magnets to the left and the vanes are retracted inwardly turning the compressor OFF. When the coil is energized the armature moves to the right, forcing the pins 69 the right, moving the magnets 52 in the same direction and aligning the poles so that the N-N poles and S-S poles are adjacent to one another. This causes the vanes to move out into engagement with the cylinder and turns the compressor ON.

In the embodiment shown in FIGS. 6 to 10 inclusive, identical reference numerals are used to designate the corresponding elements in the FIG. 1-5 embodiment described above, except that the prefix numeral "1" is used in connection therewith. For example, the cylinder wall 18 of FIG. 1 is designated 118 in FIG. 6. This will avoid needless repetition in the description of the basic compressor construction.

Instead of the axially moveable magnetic bars 52, there is a magnetic pole sleeve 70 surrounding the drive shaft 122 and rotatable relative to both the drive shaft and the rotor 120. The sleeve 70, as shown in perspective view in FIG. 9, comprises a cylindrical member having a plurality of circumferentially spaced grooves 72, which separate the discrete pole sections 74 each having a N pole at one end and a S pole at the opposite end. The polarity, i.e. the N-S orientation, alternates around the circumference of the sleeve. Each of the end faces of the sleeve is formed with a series of ratchet teeth 76, 78, each said tooth corresponding to each of the discrete pole sections. As best seen in FIG. 10, each tooth has an engagement surface and a ramp surface between adjacent engagement surfaces. For example, each tooth 76 has a drive surface **76*a* and a ramp surface 76*b*; and teeth 78 have detent surfaces 78*a* and ramp surfaces 78*b*. At the right hand side (with respect to FIG. 7) there is a latching detent mechanism including a latch dog 80 biased inwardly by means of a spring 82 received within a blind bore 84 in the rotor 120**.

On the opposite side of the rotor there is provided an electromagnetic actuator assembly which includes stationary electromagnetic coil 86 and an armature assembly including a flange 87, a sleeve 88 and a tang 90 which extend through an arcuate shaped opening 92 formed within a cylindrical insert 94 on one side of the rotor assembly. The armature is attached to the rotor by means of a helically coiled spring 96 having one end 97 embedded in a portion of the rotor and the other end 98 attached to the sleeve portion of the armature. This spring arrangement permits the armature to rotate with the rotor but allows it to move, within small increments, outwardly away from the rotor and also to rotate slightly relative to the rotor. The tang portion of the armature is engageable with the cooperating teeth 76 formed on the front of the sleeve 70 so that when the armature is slowed down relative to the sleeve, it will drag the sleeve backwards causing rotation of the sleeve relative to the rotor for a distance equal to one-half the distance between adjacent vanes. For example, looking at FIG. 8, which shows the tang resting at the right hand edge of slot 92, if the armature is dragged relative to the rotor this will force it to move to the left hand end of the arcuate slot 92. In so doing this will drag the sleeve by an equal distance relative to the rotor. At the same time, the dog on the opposite end slips into the next adjacent tooth so that when the armature is de-energized then the tang will slip outward and shift to the next adjacent tooth in effect "cocking" itself for the next energization of the armature.

It will be noted that each time the sleeve 70 shifts relative to the rotor it will bring into alignment poles in the magnetized areas of opposite polarity. This will cause the relationship of the poles on the vanes to be reversed and therefore shift between a N—N, S—S relationship, wherein the vanes are urged outwardly, to a N-S, S-N relationship wherein the vanes are pulled inwardly to reduce capacity.

While this invention has been described in connection with certain specific embodiments thereof, it is to be understood that this is by way of illustration and not by way of limitation; and the scope of the appended claims should be construed as broadly as the prior art will permit.

What is claimed is:

1. A rotary sliding vane compressor comprising: a rotor; a housing; means defining a fluid compression cavity in said housing having a fluid inlet and a fluid outlet; at least one vane carried by said rotor, said vane having a portion thereof which is permanently magnetized; and magnetic means cooperating with the permanently magnetized portion of said vane and selectively moveable between first and second positions, said first position creating a force urging said vane outwardly to effect compression of fluid introduced into said compression cavity, said second position creating a force urging said vane inwardly to reduce compression of the fluid in said compression cavity.

2. A compressor as defined in claim 1 wherein said magnetic means comprises an elongated, axially moveable bar magnet having a pair of spaced north and south poles whereby the relation between the poles on said bar magnet and the polarity of the magnetized portion of said vane may be switched between an alignment which will result in like poles repelling the vane and unlike poles retracting the vane.

3. A compressor as defined in claim 2 further including an electromagnetic actuator having an energizing coil and an armature, said armature engaging said axially moveable bar magnet to produce a linear translation of said bar magnet from one position to another.

4. A compressor as defined in claim 3 wherein said armature is axially shiftable against the force of a spring element urging said bar magnet in a direction toward said armature.

5. A compressor as defined in claim 1 wherein said magnetic means comprises a cylindrical sleeve rotatable with respect to said rotor, said sleeve being divided into discrete bar magnet segments which alternate polarity from end to end; and means for indexing said sleeve to reverse the polarity with respect to the magnetized portion of said sleeve.

6. A compressor as defined in claim 5 including an electromagnetic actuator having a energizing coil, an armature and a tang portion operatively associated with said armature adapted to engage said sleeve and thereby effect relative rotation between said sleeve and said rotor.

7. A compressor as defined in Claim 6 including a latching detent to hold said sleeve relative to said rotor after indexing motion has occurred.

8. A rotary sliding vane compressor comprising: a housing having a compression cavity formed therein with a fluid inlet and a fluid outlet communicating with said cavity; a rotor positioned within said housing, said rotor having a plurality of slots receiving reciprocably moving vanes adapted to compress a fluid introduced into said compression cavity as the vanes move from said inlet to said outlet, each said vane having a portion thereof which is permanently magnetized to provide a north pole and a south pole; and moveable magnetic means controlling the position of each said vane, said magnetic means including a north pole and a south pole which are selectively moveable with respect to said vanes such that in one position the respective south poles and north poles cooperate to urge the vane radially outwardly, and in another position wherein the north pole of said magnetic means and the south pole of each said vane cooperate to attract the vanes radially inwardly to reduce the pumping capacity of said compressor.

9. A compressor as defined in claim 8 wherein said magnetic means comprises an elongated, axially moveable bar magnet having a pair of spaced north and south poles whereby the relation between the poles on said bar magnet and the polarity of the magnetized portion of said vane may be switched between an alignment which will result in like poles repelling the vane and unlike poles retracting the vane.

10. A compressor as defined in claim 9 further including an electromagnetic actuator having an energizing coil and an armature, said armature engaging said axially moveable bar magnet to produce a linear translation of said bar magnet from one position to another.

11. A compressor as defined in claim 10 wherein said armature is axially shiftable against the force of a spring element urging said bar magnet in a direction toward said armature.

12. A compressor as defined in claim 8 wherein said magnetic means comprises a cylindrical sleeve rotatable with respect to said rotor, said sleeve being divided into discrete bar magnet segments which alternate polarity from end to end; and means for indexing said sleeve to reverse the polarity with respect to the magnetized portion of said sleeve.

13. A compressor as defined in claim 12 including an electromagnetic actuator having a energizing coil, an armature, and a tang portion operatively associated with said armature adapted to engage said sleeve and thereby effect relative rotation between said sleeve and said rotor.

14. A compressor as defined in claim 13 including a latching detent to hold said sleeve relative to said rotor after indexing motion has occurred.

15. A rotary sliding vane compressor of the type including a rotor positioned within a compression cavity defined in part by a cylindrical stator surface and having a fluid inlet and a fluid outlet; a plurality of vanes carried by said rotor, each vane having a tip portion in engagement with said cylindrical stator surface and a lower edge which is permanently magnetized to provide a north pole and a south pole; magnetic means cooperating with the north and south poles on said vanes to force the vanes outwardly against the cylindrical surface when in one position and retract the vane radially inwardly when in another position.

16. A compressor as defined in claim 15 wherein said magnetic means comprises an elongated, axially moveable bar magnet having a pair of spaced north and south poles whereby the relation between the poles on said bar magnet and the polarity of the magnetized portion of said vane may be switched between an alignment which will result in like poles repelling the vane and unlike poles retracting the vane.

17. A compressor is defined in claim 16 further including an electromagnetic actuator having an energizing coil and an armature, said armature engaging said axially moveable bar magnet to produce a linear translation of said bar magnet from one position to another.

18. A compressor as defined in claim 17 wherein said armature is axially shiftable against the force of a spring element urging said bar magnet in a direction toward said armature.

19. A compressor as defined in claim 15 wherein said magnetic means comprises a cylindrical sleeve rotatable with respect to said rotor, said sleeve being divided into discrete bar magnet segments which alternate polarity from end to end; and means for indexing said sleeve to reverse the polarity with respect to the magnetized portion of said sleeve.

20. A compressor as defined in claim 19 including an electromagnetic actuator having a energizing coil, an armature and a tang portion operatively associated with said armature and adapted to engage said sleeve and thereby effect relative rotation between said sleeve and said rotor.

21. A compressor as defined in claim 20 including a latching detent to hold said sleeve relative to said rotor after indexing motion has occurred.

* * * * *